US005755585A

United States Patent [19]

Cheng et al.

[11] Patent Number: 5,755,585

[45] Date of Patent: May 26, 1998

[54] DUPLEX PROFILE CONNECTOR ASSEMBLY

[75] Inventors: Lee-Ming Cheng, Cupertino; Edmond Choy, Union City, both of Calif.; Gwou-Jong Tseng, Tu-Chen, Taiwan

[73] Assignee: Hon Hai Precision Ind. Co., Ltd., Taipei, Taiwan

[21] Appl. No.: 692,823

[22] Filed: Jul. 29, 1996

Related U.S. Application Data

[63] Continuation-in-part of Ser. No. 393,704, Feb. 24, 1995.

[51] Int. Cl.[6] ..... H01R 13/62

[52] U.S. Cl. ..... 439/326

[58] Field of Search ..... 439/326, 327, 439/328, 64, 541.5

[56] References Cited

U.S. PATENT DOCUMENTS 5,030,115 7/1991 Regnier et al. ..... 439/541.5

5,176,523 1/1993 Lai ..... 439/541.5

*Primary Examiner*—Gary F. Paumen

*Assistant Examiner*—Yong Ki Kim

[57] ABSTRACT

A connector assembly (10) includes a lower housing (14) and an upper housing (12) each generally including the basic structure of the typical SO DIMM connector housing (16, 16'). Each housing (14, 12) defines two rows of passageways (20, 20') on two sides of the central slot (18, 18') in which the corresponding module (100) is received. A plurality of contacts (40, 42, 50, 52) are received within the corresponding passageways (20, 20') wherein the tail of each contact (40, 42, 50, 52) extends downward to engage the corresponding circuit on the PC board (100) on which the connector assembly (10) is mounted. The upper housing (12) includes a standoff portion (30) thereabouts wherein the standoff's thickness is generally equal to the thickness of the lower housing (14) so that the upper housing (12) defines a space (32) thereunder to have the lower housing (14) positioned therein under the condition that the upper housing (12) and lower housing (14) are substantially offset with each other in the front-to-end direction.

11 Claims, 12 Drawing Sheets

DUPLEX PROFILE CONNECTOR ASSEMBLY

BACKGROUND OF THE INVENTION

1. Field of The Invention

This application is a continuation-in-part of pending application Ser. No. 08/393,704 filed Feb. 24, 1995, of which the specification is incorporated by reference into this specification. The invention relates to electrical connector assemblies, and particular to the SO DIMM connector assembly which substantially has a 10 mm height which is two times than that of a general low profile SO DIMM.

2. The Prior Art

The copending parent application discloses how two simplex type SO DIMM connectors are generally stacked with each for respectively receiving two modules therein without interference. As mentioned in the copending application, the reason why such two SO DIMM connectors are arranged to be stacked with each other is to save the layout space on the PC board. Anyhow, to comply with the requirements of the circumstances the connector assembly confronts, i.e., the PC board layout limitation and the height restriction, it is desired to have alternative designs, thus being easy and economic for the connector manufacturer to produce the electrical connector, and meeting such requirements of PC board or of computer manufacturers.

Therefore, the present invention further develops how to arrange the structures of the upper connector and the lower connector, including their housing and the corresponding contacts therein so that both the lower connector and the upper connector can be scientifically and systematically arranged stackably to be mounted on the PC board, and also define a sufficient space for both of the lower and the upper connectors for insertion of the corresponding modules therein, respectively, without interference. Alternatively, in some alternative PC board design, the module, which is originally designedly received within the lower connector, might have been already solderably mounted on the PC board. Therefore, it is unnecessary to have the connector assembly includes two separate connector units for reception of the upper level module and the lower level module, respectively, in this situation. Thus, the present invention further discloses a simplified connector assembly which is adapted to receive only an upper level module therein under the condition that the lower level module has been already permanently mounted on PC board and generally positioned below the upper level connector.

SUMMARY OF THE INVENTION

According to an aspect of the invention, a connector assembly includes a lower housing and an upper housing each generally including the basic structure of the typical SO DIMM connector housing. Each housing defines two rows of passageways on two sides of the central slot in which the corresponding module is received. A plurality of contacts are received within the corresponding passageways wherein the tail of each contact extends downward to engage the corresponding circuit on the PC board on which the connector assembly is mounted. The upper housing includes a standoff portion thereabouts wherein the standoff's thickness is generally equal to the thickness of the lower housing so that the upper housing defines a space thereunder to have the lower housing positioned therein under the condition that the upper housing and lower housing are substantially offset with each other in the front-to-end direction.

Alternatively, the lower housing may be removed therefrom and the upper housing can be formed with an extended standoff portion whereby the original under-space thereof for reception of the lower housing is gone. The whole upper housing is of a raised type whereby the module is received in the upper housing at the upper level, and is generally positioned above a module which has been permanently soldered on the PC board.

DETAILED DESCRIPTION OF THE PREFERRED EMBODIMENTS

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
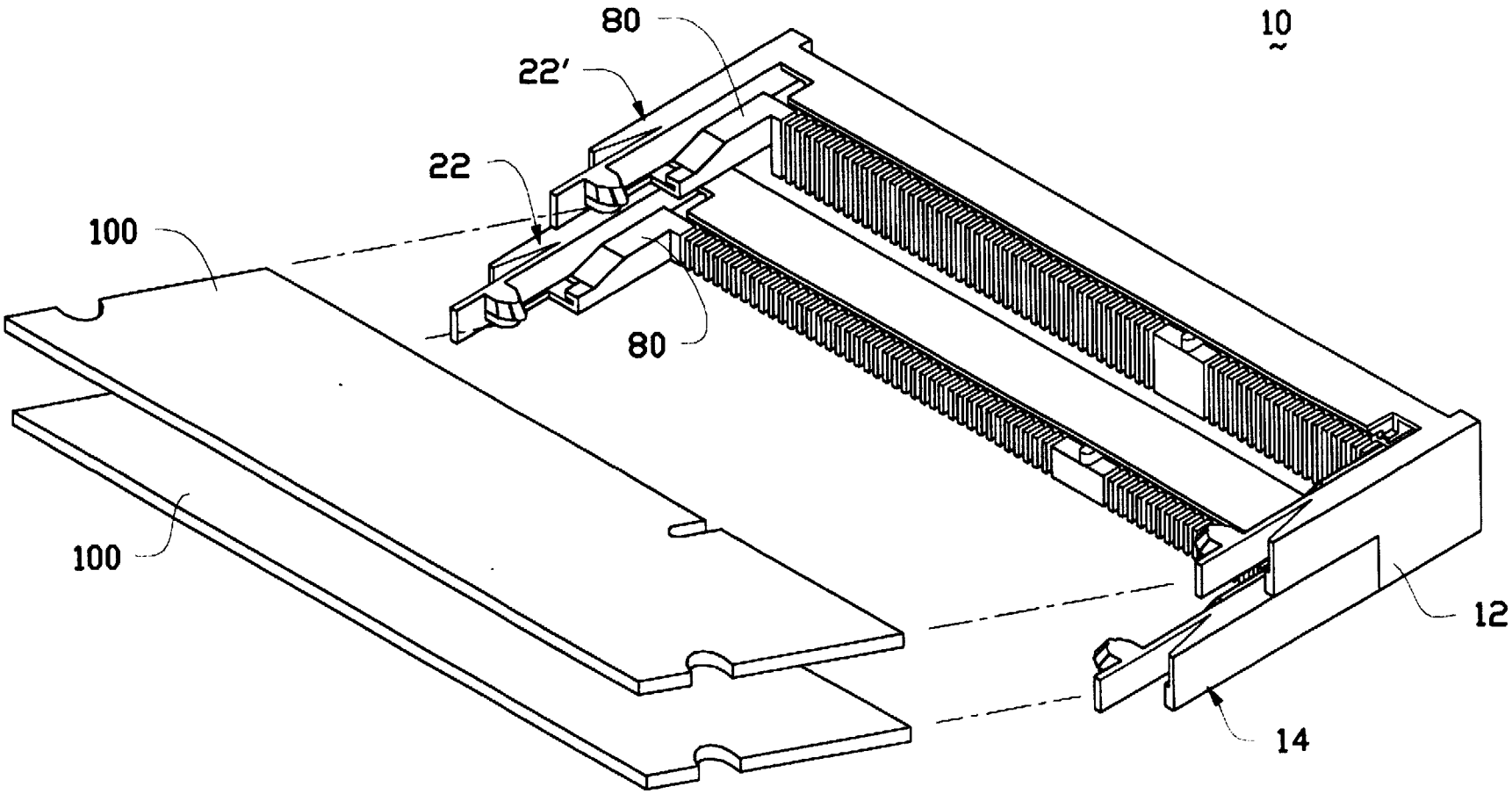
FIG. 1 is a perspective view of a present preferred embodiment of an electrical connector assembly comprising an upper housing and lower housing, according to the invention, wherein the metal members have not been attached to corresponding latch sections thereof.
Figure 2:
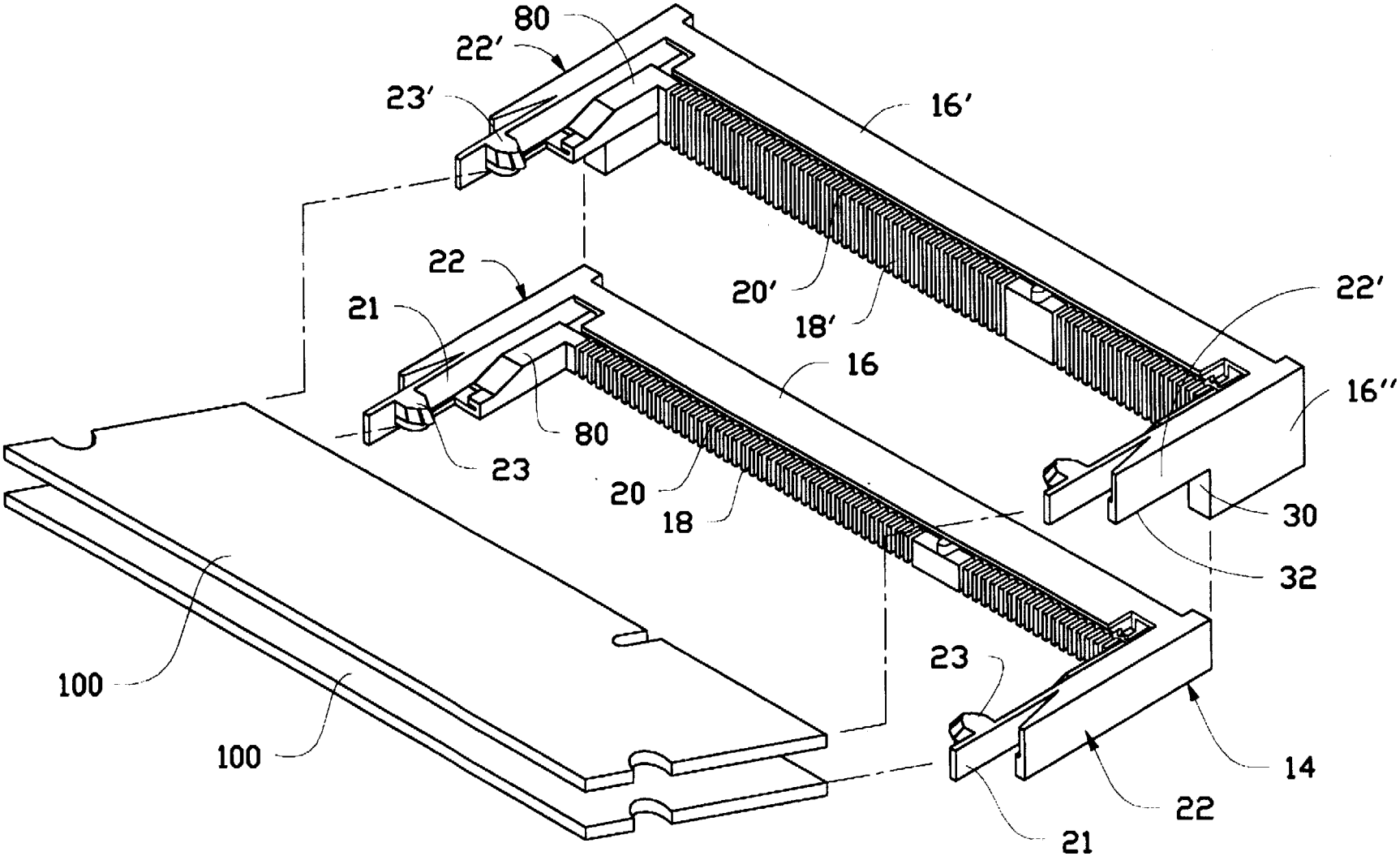
FIG. 2 is an exploded perspective view of the connector assembly of FIG. 1.

It will be noted here that for a better understanding, most of like components are designated by like reference numerals throughout the various figures in the embodiments. Attention is directed to FIGS. 1 and 2 wherein an electrical connector assembly 10 includes an upper housing 12 and a lower housing 14 respectively receiving a module 100 therein. The structure of the housing 12 or 14, and how the modules is retainably received therein can be also referred to the copending application Ser. No. 08/627,143 filed Apr. 3, 1996.

Figure 4:
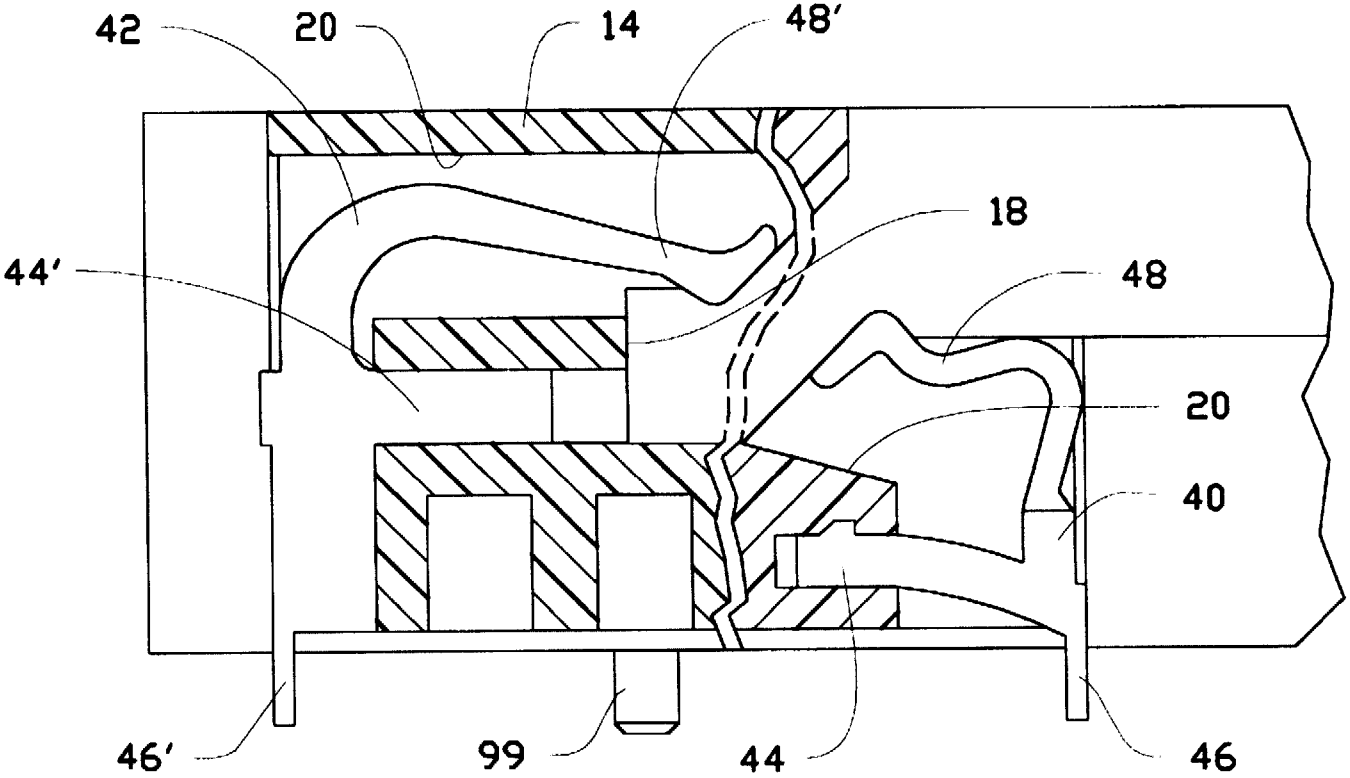
FIG. 4 is a cross-sectional view of the lower housing of FIG. 1 with corresponding contacts therein.
Figure 5:
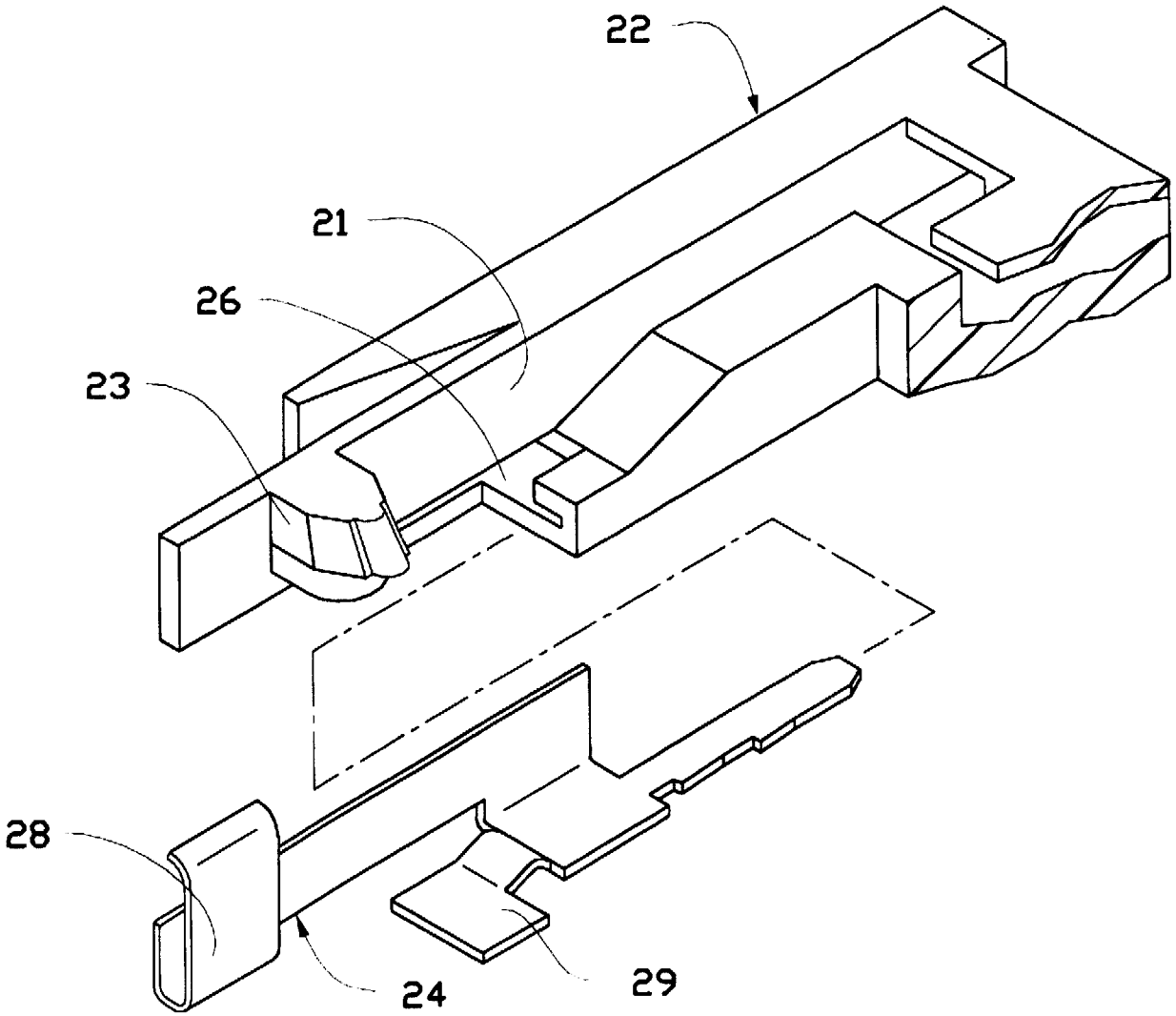
FIG. 5 is a fragmentary perspective view of the lower housing of FIG. 1 with an auxiliary separate metal member adapted to be attached thereto to show detailed structures of the housing.

In general, also referring to FIGS. 4 and 5, the lower housing 14 includes an insulative elongated body 16 defining a central slot 18 therein for receiving the module 100, and two rows of passageways 20 by two sides of the slot 18. A pair of latch section 22 each with a flexible arm 21 associated with an 25 enlarged locking engagement head 23 at the top, are formed on two opposite ends of the body 16, extending in a front-to-back direction and parallel to each other. A auxiliary metal member 24 can be optionally inserted into the cavity 26 in each latch section 22 by the outer side of the corresponding flexible arm 21. The metal member 24 further includes a grasping section 28 which can cooperate with the flexible arm 21 for outward deflection of the flexible arm 21 for releasing the module 100 from the housing 14. The general structure of the metal member 24 in this application can be also referred to the aforementioned copending application Ser. No. 08/627,143.

Figure 3:
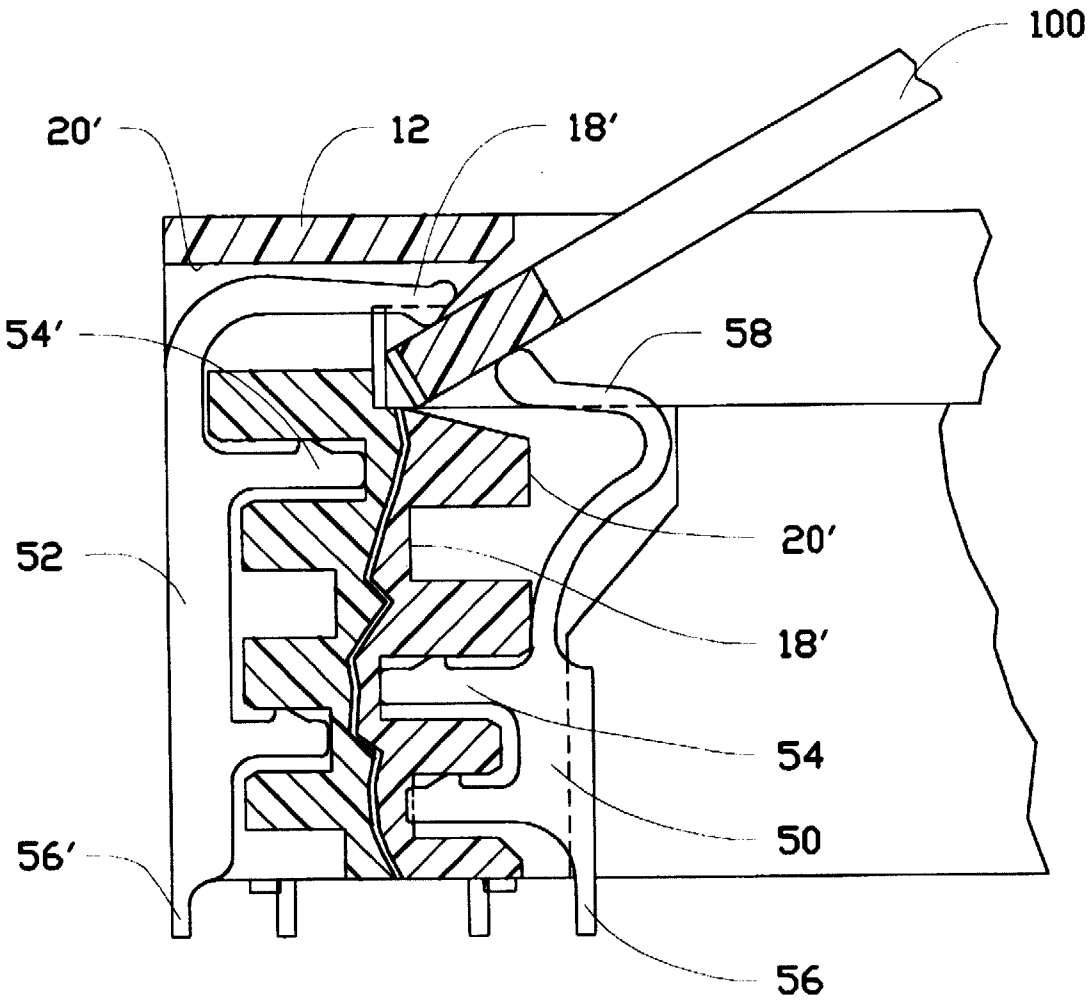
FIG. 3 is a cross-sectional view of the upper housing of FIG. 1 with corresponding contacts therein.

Similar to the lower housing 14, also referring to FIG. 3, the upper housing 12 includes the insulative elongated body 16' defining the central slot 18' for receiving another module 100 therein. Different from the lower housing 14, the upper housing 12 further includes a standoff portion 30 generally integrally formed along the underside of the body 16' so that in the appearance the upper housing substantially can be deemed to define a raised elongated body 16".

Accordingly, similar to the lower housing 14, the upper housing 12 also includes two rows of the passageways 20' by two sides of the slot 18', while each of the passageways 20' of the upper housing 12 extends downwardly through the whole raised body 16" including the originally dimensioned body 16' and the standoff portion 30.

Because of the standoff portion 30 of the upper housing 12, a recess 32 is formed under the latch section 22' thereof. Thus, when the upper housing 12 and the lower housing 14 are stacked with each other, the lower housing 14 is arranged to be positioned on the front side of the standoff portion 30 of the upper housing 12 and under the latch sections 22' thereof. In other words, the lower housing 14 and the upper housing 12 are in a relatively offset relationship in the front-to-back direction. This arrangement is designed to avoid any possible interference between the upper housing 12 and the module 100 of the lower housing 14 during its insertion process, and such intention is similar to that of the parent application and will be discussed in detail later.

Figure 6:
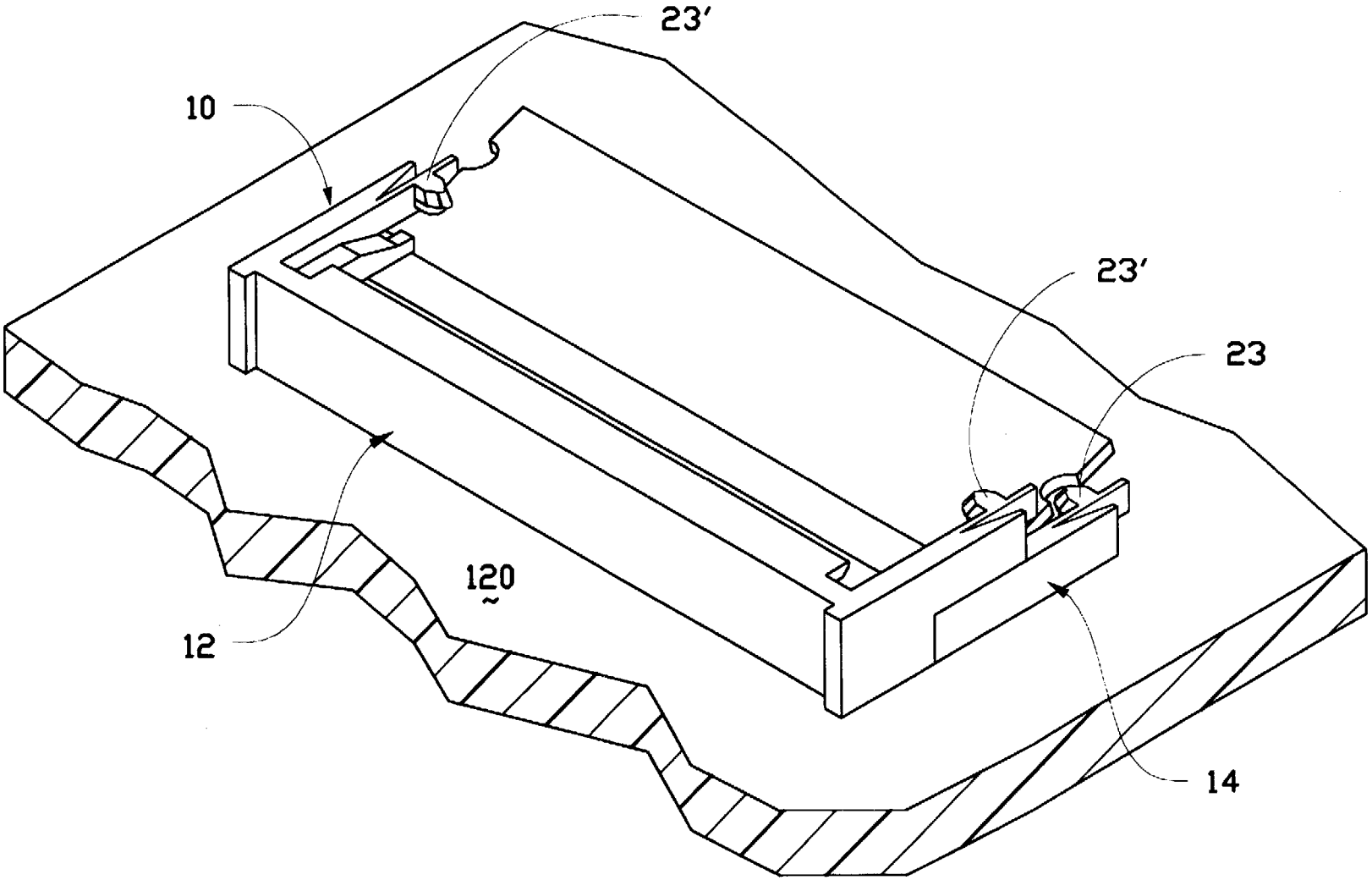
FIG. 6 is a perspective view of the assembled connector assemble of FIG. 1 to show how the lower level module can be inserted into the lower housing without interfering with the upper housing.

As shown in FIG. 4, the contacts 40 and the contacts 42 are respectively received within the corresponding lower row and upper row passageways 20 wherein the contacts 40 are inserted into the corresponding passageways 20 from the front side, and the contacts 42 are inserted into the corresponding passageways 20 from the back. The contact 40 includes a retention section 44 in an interference fit within the corresponding passageway 20 for retaining the contact 40 within the housing 14, a mounting section 46 for solderably mounting to the mother board 120 (FIG. 6) on which the electrical connector assembly 10 is seated, and an engagement section 48 projecting into the central slot 18 for engagement with the corresponding circuit pads on the inserted module 100. Similarly, the contact 42 of the upper housing 12 includes a retention section 44', a mounting section 46' and an engagement section 48'. Differently, the contact 42 of the lower housing 14 is inserted into the corresponding passageway 20 from the back.

Similar to the contacts 40, 42 of the lower housing 14, referring to FIG. 3, the contacts 50, 52 of the upper housing 12, include the retention sections 54, 54', the mounting sections 56, 56' and the engagement sections 58, 58' wherein the contacts 50 thereof are inserted therein from the front side and the contacts 52 thereof are inserted therein from the back.

As being paid attention to in the previous parent application Ser. No. 08/393,704, prevention of interference of the insertion of the module 100 of the lower housing 14 with regard to the upper housing 12 is designedly managed in this application. The offset between the lower housing 14 and the upper housing 12 along the front-to-back direction allows obstacle-free insertion and downward rotation of the module 100 of the lower housing 14 because the initial insertion angle of the module 100 of the lower housing 14 is substantially positioned below the enlarged locking engagement head 23' of the upper housing 12 from the beginning of the insertion to the end of the rotation of the module 100 of the lower housing 14.

It can be understood that the lower housing 14 can be securely fastened unto the mother board by the mounting sections 46, 46' of the contacts 40, 42, and optimally by the mounting pads 29 of the metal members 24. In the upper housing 12, the mounting pads of the metal members (not shown) are omitted due to the structural restriction, while glue means can be applied to the opposing portions of the upper housing 12 and of the lower housing 14 for reinforcing the securement of the upper housing 12 unto the mother board. It is also appreciated that having the integrally molded downward extending post 99 under the bottom of the housing 12 or 14 to cooperate with the corresponding holes in the mother board 120 with an interference fit, is also recommended for securement consideration of the housing 12, 14.

The above first embodiment generally discloses an electrical connector assembly 10 including the separate upper and lower housings 12, 14 for respective reception of two modules 100 therein. As mentioned before, an alternative embodiment as shown in FIGS. 7–10 is desired when the first or the lower level module has been permanently soldered on the mother board, as a basic required component thereof, by the mother board manufacturer. In this situation, it is unnecessary to have such electrical connector assembly 10 consists of the lower housing and the upper housing for respectively receiving the lower level and the upper level modules therein.

Figure 7:
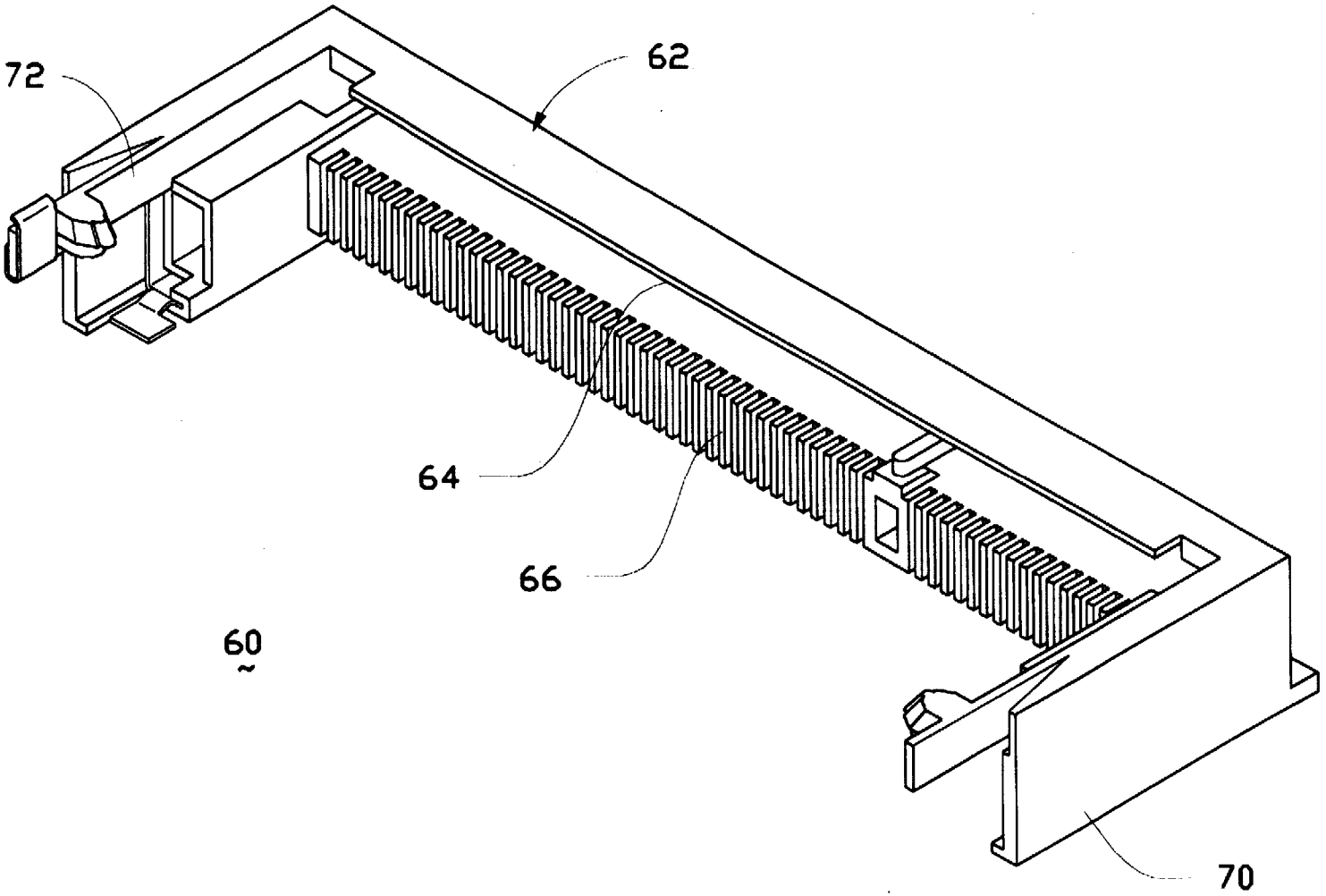
FIG. 7 is a perspective view of a second embodiment of the connector assembly which has the upper housing with an extended standoff portion wherein one auxiliary metal member is attached to the corresponding latch section for illustration.
Figure 8:
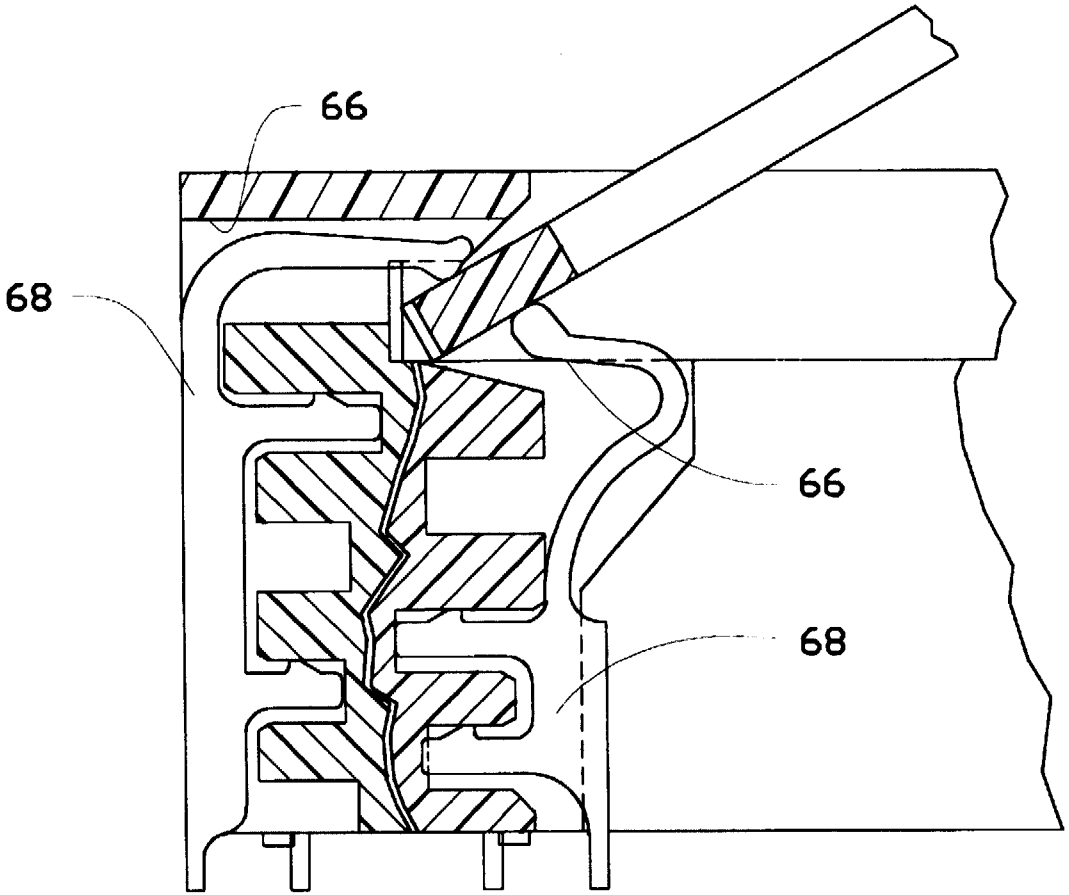
FIG. 8 is a cross-sectional view of the connector assembly of FIG. 7 to show the corresponding contacts therein.
Figure 9:
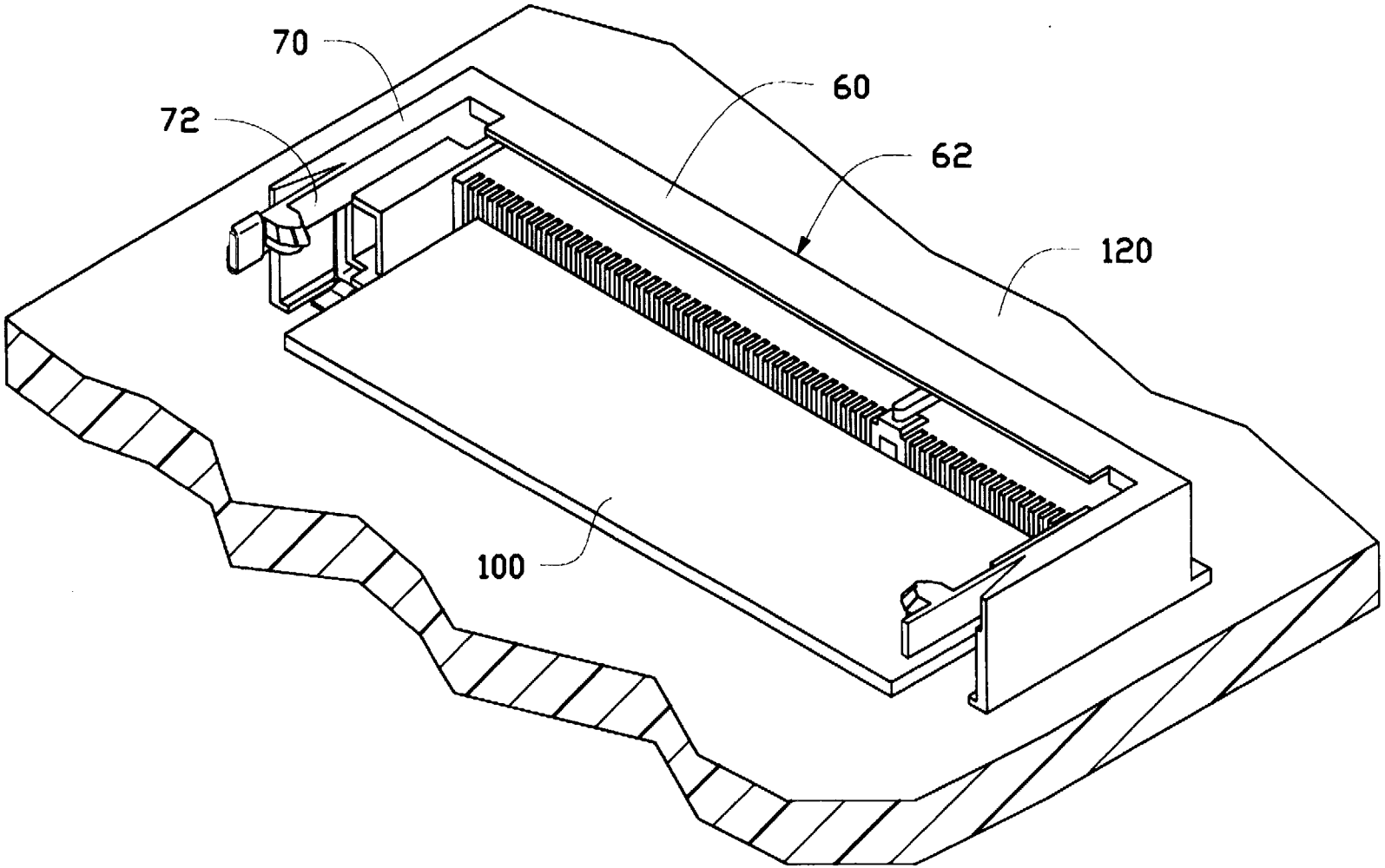
FIG. 9 is a perspective view of the connector assembly of FIG. 7 mounted on the PC board wherein a lower level has been already solderably mounted on the PC board and generally circumscribed within the region defined by the connector assembly.
Figure 10:
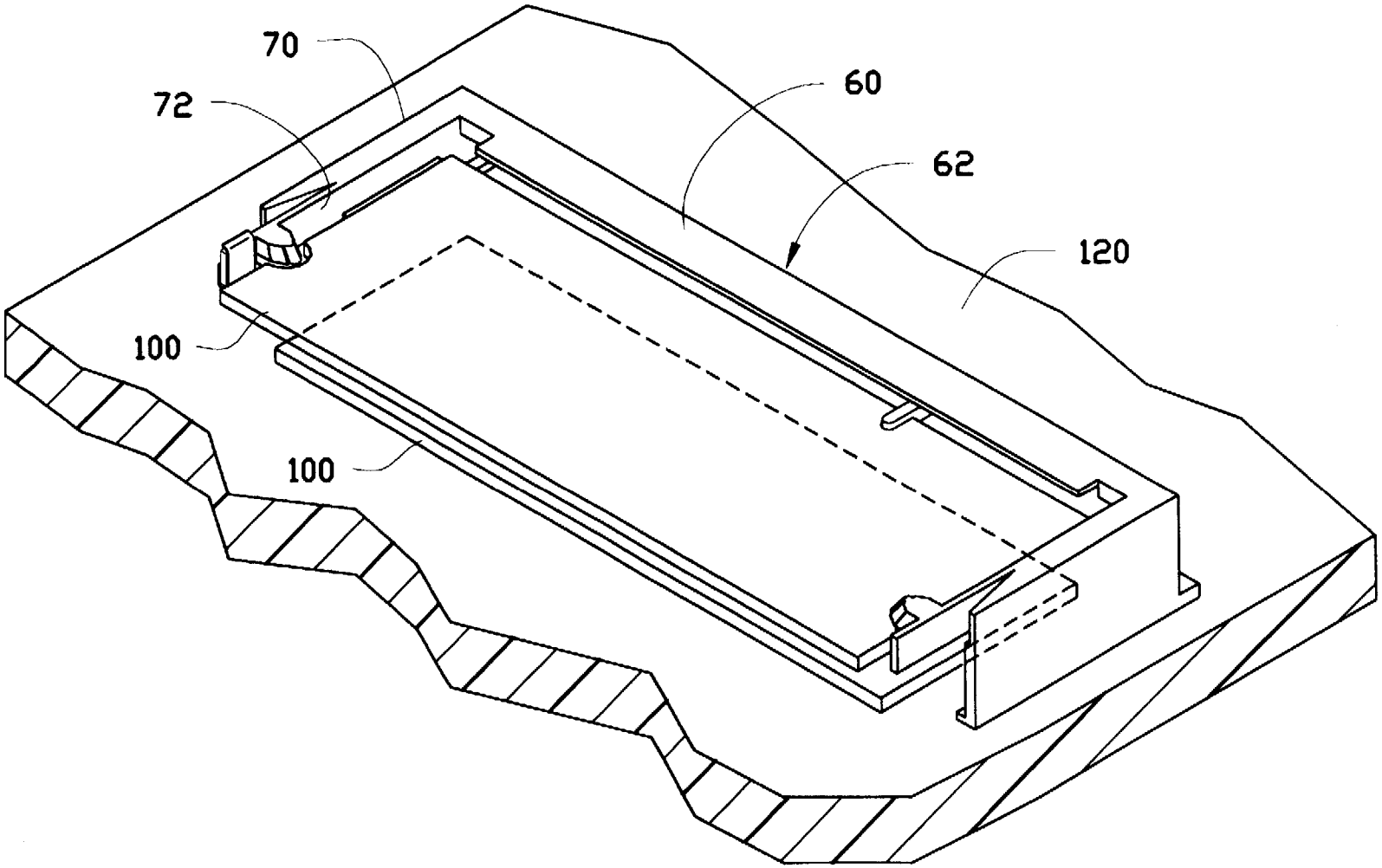
FIG. 10 is a perspective view of the connector assembly of FIG. 9 on the PC board having the upper level module received therein wherein such upper level module is substantially positioned, in a vertical direction, above the lower level module mounted on the PC board.

Therefore, different from the first embodiment, the second embodiment in FIGS. 7 and 8, discloses the electrical connector assembly 60 consists of only one housing 62 having a central slot 64 with two-row passageways 66 for receiving a plurality of contacts 68 therein. Most portions of the housing 62 and its associated contacts 68 are similar to those of the upper housing 12 and the associated contacts 50, 52 thereof in the first embodiment. In the second embodiment, the recess 32 of the upper housing 12 disclosed in the first embodiment has been occupies by the substantive molded material, thus forming a complete fully forwardly extending latching section 70 thereof. Therefore, different from the connector assembly 10 in the first embodiment in which the upper housing 12 need to cooperate with the lower housing for its securement with regard to the mother board 120, the connector assembly 60 in the second embodiment can independently mountably stand on the mother board 120 by its elongated latching sections 70 on two sides. It is noted that even though the height of the latching section 70 is almost double than that of the latching section 22' of the upper housing 12 in the first embodiment, the flexible arm 72 thereof in the second embodiment still keeps the same dimension as that in the first embodiment for resiliency consideration. Anyhow, referring to FIGS. 9 and 10, similar to the upper housing 12 of the electrical connector assembly 10 in the first embodiment, the unitary housing 62 of the electrical connector assembly 60 of the second embodiment also provides a sufficient space in which the lower level module 100, even being permanently mounted on the mother board 120, can be positioned under the upper module 100 which is adapted to be received within the slot 64 of the housing 62. Under this situation, the lower module 100 and the upper module 100 can be arranged in a double deck manner for saving the layout of the mother board 120 if they are side by side disposed on the mother board 120.

Referring to FIGS. 1 and 2, the design of the first embodiment in this application still follows the spirit of the previous parent application including a shortened supporting plate 80 of the latching section 22 (22') and/or the offset arrangement of the upper housing 12 and the lower housing 14 in the front-to-back direction. These two features can be referred to FIGS. 2A–2C and 4 in the copending parent application, respectively. Understandably, these features in both applications are designed arranged for non-interference between the lower level module and the latching sections of the upper housing/connector during insertion and rotation of such module.

Figure 11:
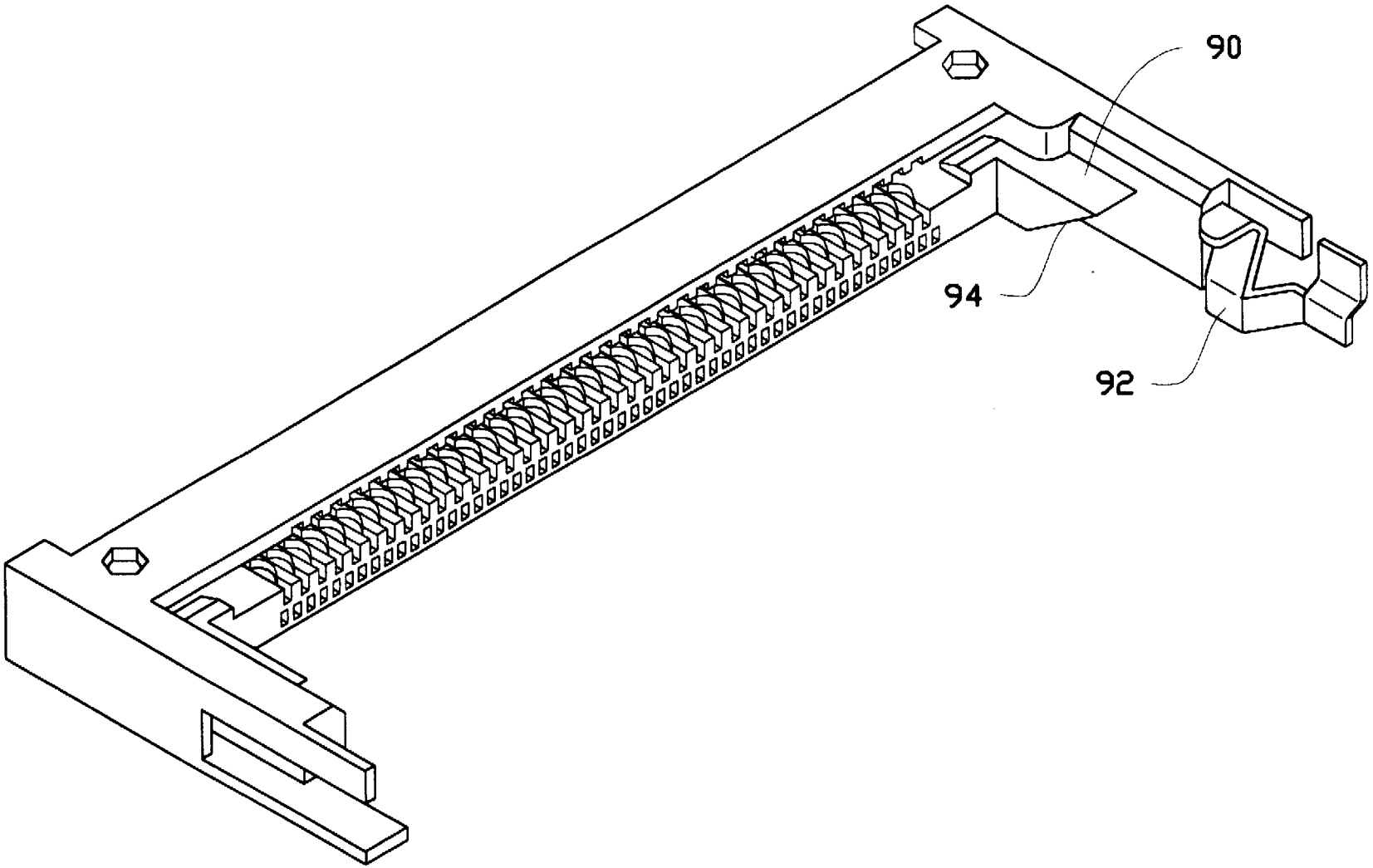
FIG. 11 is a perspective view of an electrical connector disclosed in the parent application, which is adapted to be stacked on another one as shown in FIG. 1.

FIG. 11 hereof shows the same design disclosed in FIG. 2B of the parent application. It can be seen that the supporting plane 90, on which the module is seated, is stopped at a position which is far from the distal front end of the latch section 92. Further more, a cut-off 94 is formed under such supporting plane 90 for forming an additional space for not interfering with the lower level module. The conventional connectors lack this feature and thus can not efficiently achieve the stacked usage within a limited space.

Figure 12:
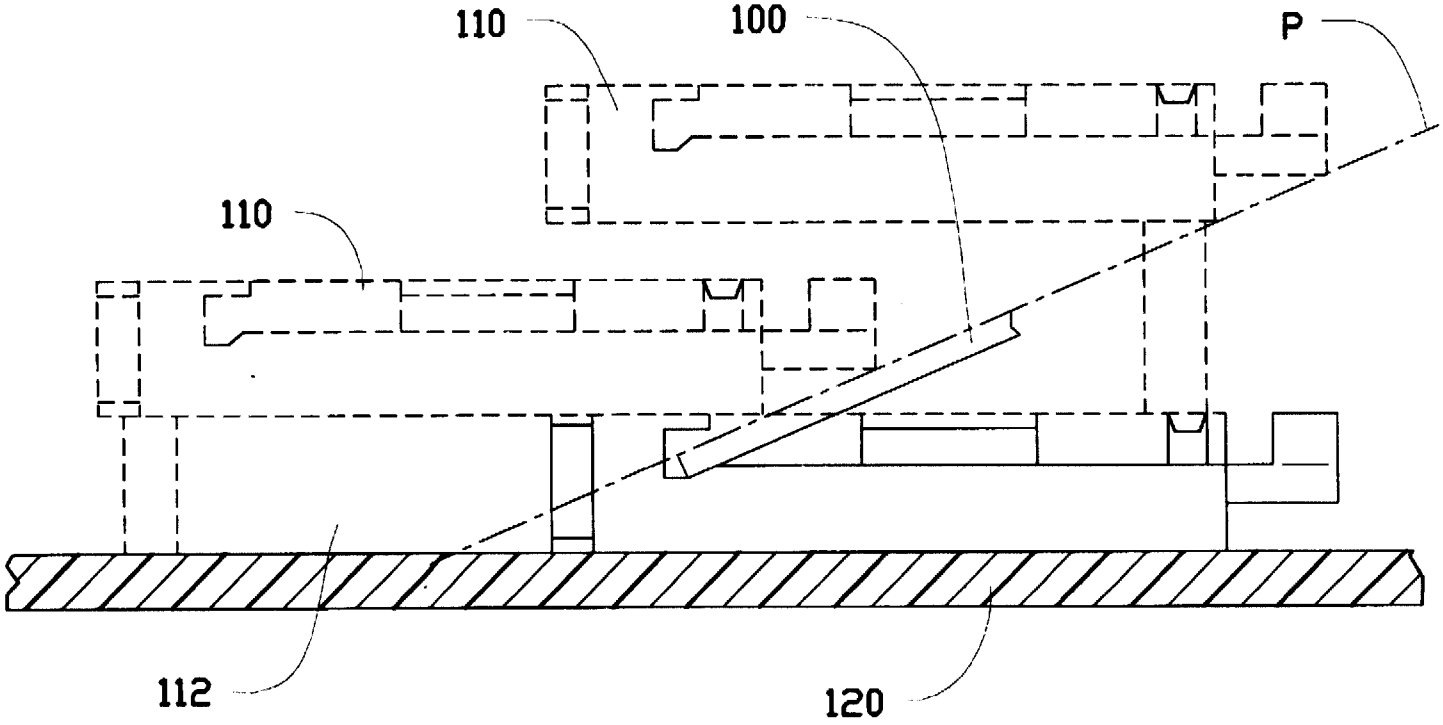
FIG. 12 is a side view of another embodiment of the present invention which was disclosed in the parent application.

FIG. 12 shows the same design as disclosed in FIG. 4 of the parent application wherein the upper housing/connector 110 has been intentionally offset from the lower housing/connector 112 in either along a front-to-back direction or along a vertical direction so that the lower level module 100 will not interferentially confront any substantial portion of the upper housing/connector 110 from its initial insertion to its successive rotation and final retention. From another viewpoint, no substantial portions of the upper connector 110 between such pair of opposite latching sections thereof or under an imaginary plane P defined by the insertion angular position of the lower level module 100, exist to interfere with the initial inserted and successive rotated lower level module 100.

Therefore, it is contemplated that the features disclosed in the present application generally complies with those in the parent application.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

We claim:

1. An electrical connector assembly for use with two modules, comprising:

a lower housing having an insulative first body defining a first central slot for receiving a lower level module therein;

two-row passageways positioned by two sides of the first slot for receiving a plurality of first contacts therein;

a pair of first latching sections extending forwardly at two opposite ends of the first body of the lower housing so that the lower level module can be inserted into the first slot at an angle and successively rotated to a horizontal position for retention;

an upper housing having the second insulative body defining a second central slot for receiving an upper level module therein;

two-row passageways disposed on two sides of the second slot for receiving a plurality of second contacts therein;

a pair of second latching sections disposed on two opposite ends of the second body of the upper housing so that the upper level module can be inserted into the second slot at an angle and successively rotated to a horizontal position for retention; wherein the upper housing further includes a standoff portion integrally formed with the second body, thus defining a recess under each of the second latching sections of the upper housing so that the upper housing can be stacked unto the lower housing under the situation that the lower housing is positioned in front of the standoff portion of the upper housing and under the second latching sections of the upper housing, thus forming an offset in a front-to-back direction between the upper housing and the lower housing.

2. The assembly as described in claim 1, wherein each of said second latching sections of the second body of the upper housing includes, a flexible arm with an expanded head at a top portion, and the lower level module is structurally under said head during initial insertion through successive rotation and final retention.

3. The assemble as described in claim 1, wherein each of the second latching sections of the upper housing has a shortened supporting plate in comparison with a full front-to-back dimension of said corresponding second latching section.

4. An electrical connector assembly for use with two modules, comprising:

a single housing including an insulative elongated body defining a central slot for receiving an insertable module therein;

two-row passageways disposed on two sides of the slot for receiving a corresponding number of contacts therein;

a pair of latching sections forwardly extending at two opposite ends of the body; and a standoff portion generally positioned below the body whereby a space is formed around said standoff portion and under an upper level module which is received within the slot of the housing, and said space is arranged to be large enough for receiving a lower level module which is soldered on the board on which said assembly is mounted.

5. The assembly as described in claim 4, wherein said standoff portion fully extends lengthwise along the body and forwardly along the latching sections.

6. An arrangement for electrically connecting two modules to a mother board, comprising:

a first housing having an insulative first body for receiving a first module which is closer to the mother board than a second module;

a second housing having an insulative second body for receiving the second module;

the second housing further includes a standoff portion positioned under the second body; wherein the first housing is substantially positioned in front of and beside the standoff portion, and the first housing and the second housing are offset with each other along a front-to-end direction so that the first module will not interferentially confront any portions of the second housing from its initial insertion, successive rotation to final retention with regard to the second housing.

7. The assembly as described in claim 6, wherein the second housing further includes latching sections extending forward on two opposite ends of the second body, and a recess is formed under each of said latching sections for receiving the first housing therein.

8. An upper connector for use with a lower connector on which said upper connector is directly and tightly seated, comprising:

a housing having an elongated body defining a central slot for receiving an upper level module therein, and a plurality of contacts beside the slot for electrical and mechanical engagement with the upper level module;

a pair of latching sections extending forward at two opposite ends of the body, each of said latching sections including a shortened supporting plane in comparison with a full lengthwise dimension of said corresponding latching section, whereby a lower level module can be inserted into and rotated with regard to the lower connector without interfering with any portions of each of said supporting plane of said latching sections of the upper connector.

9. The upper connector as described in claim 8, wherein a cut-off is formed under the supporting plane to provide additional space for facilitating insertion of said lower level module in the lower connector without any improper interference with the upper connector.

10. An arrangement of a connector assembly mounted on a PC board, comprising:

an upper connector and a lower connector generally stacked with each other wherein each of said connectors is adapted to receive a module in a first position which is angular with the PC board and to retain said module in a second position which is parallel to the PC board;

the upper connector including a housing having a pair of opposite latching sections respectively extending forward at two opposite ends thereof, both of said latching sections commonly defining therebetween a dimension substantially equal to a lengthwise dimension of the module; and a supporting surface being integrally formed of the corresponding latching section of the upper connector for supporting an upper level module thereon; wherein the housing of said upper connector has no substantial portions between said pair of latching sections or under an imaginary plane defined by a lower level module when said lower level module is inserted into the lower connector at a predetermined angle with regard to the PC board, so that no interference will occur between the upper connector and the lower level module during initial insertion, successive rotation and final retention of lower level module with regard to the lower connector.

11. The arrangement as described in claim 10, wherein the upper connector and the lower connector are offset with each other along a front-to-end direction and/or a vertical direction.

* * * * *